US007308921B1

(12) United States Patent
Brewer, Sr.

(10) Patent No.: US 7,308,921 B1
(45) Date of Patent: Dec. 18, 2007

(54) HORIZONTAL CURVE SAWING APPARATUS

(76) Inventor: Clarence R. Brewer, Sr., P.O. Box 150, Central City, KY (US) 42330

( * ) Notice: Subject to any disclaimer, the term of this patent is extended or adjusted under 35 U.S.C. 154(b) by 183 days.

(21) Appl. No.: 11/020,991

(22) Filed: Dec. 22, 2004

Related U.S. Application Data

(63) Continuation-in-part of application No. 10/317,896, filed on Dec. 12, 2002, now abandoned.

(60) Provisional application No. 60/360,591, filed on Feb. 28, 2002.

(51) Int. Cl.
*B27M 1/08* (2006.01)

(52) U.S. Cl. ..... 144/3.1; 144/394; 83/368; 83/371; 83/794

(58) Field of Classification Search ..... 144/356, 144/357, 376, 378, 394, 404, 409, 416, 2.1, 144/3.1; 83/76.8, 368, 371, 404.1, 102.1, 83/420, 732, 445, 75, 72, 446, 425, 425.2, 83/367, 789, 63, 62.1, 58
See application file for complete search history.

(56) References Cited

U.S. PATENT DOCUMENTS

| | | | | |
|---|---|---|---|---|
| 259,661 | A | | 6/1882 | Bowker |
| 1,263,443 | A | | 4/1918 | Lien |
| 1,482,711 | A | | 2/1924 | Sorenson |
| 4,127,044 | A | | 11/1978 | Kenyon |
| 4,144,782 | A | | 3/1979 | Lindstrom |
| 4,250,935 | A | | 2/1981 | Helgesson et al. |
| 4,373,563 | A | | 2/1983 | Kenyon |
| 4,881,584 | A | * | 11/1989 | Wislocker et al. ..... 144/39 |
| 4,941,100 | A | | 7/1990 | McFarlane et al. |
| 4,947,909 | A | | 8/1990 | Stroud |
| 5,088,363 | A | | 2/1992 | Jones et al. |
| 5,201,351 | A | * | 4/1993 | Hurdle, Jr. ..... 144/39 |
| 5,400,842 | A | | 3/1995 | Brisson |
| 5,722,474 | A | | 3/1998 | Raybon et al. |
| 5,816,302 | A | | 10/1998 | Newnes |
| 5,832,975 | A | | 11/1998 | Hamby, Jr. |
| 5,884,682 | A | | 3/1999 | Kennedy et al. |
| 6,062,281 | A | * | 5/2000 | Dockter et al. ..... 144/357 |
| 6,178,858 | B1 | * | 1/2001 | Knerr et al. ..... 83/76.8 |
| 6,494,240 | B1 | | 12/2002 | Brisson |
| 2002/0152861 | A1 | | 10/2002 | Conry |

* cited by examiner

*Primary Examiner*—Shelley M. Self
(74) *Attorney, Agent, or Firm*—Theresa Fritz Camoriano; Camoriano and Associates

(57) ABSTRACT

A saw for cutting a cant by sensing the curvature of the cant and raising or lowering the saw blade in order to follow the curvature when cutting the cant.

1 Claim, 11 Drawing Sheets

10
18
48

50
54
58
12
44
46
48A
40
50
52
28
42
68
14
56
30A
80
30B
86
14
16

HORIZONTAL CURVE SAWING APPARATUS

This application is a continuation-in-part of U.S. Utility application Ser. No. 10/317,896, filed Dec. 12, 2002 now abandoned, which claims priority from U.S. Provisional Application Ser. No. 60/360,591, filed Feb. 28, 2002, both of which are hereby incorporated herein by reference.

BACKGROUND OF THE INVENTION

The present invention relates to a sawing apparatus for cutting a cant along a curve. More particularly, it relates to a sawing apparatus which senses the curvature of a cant along a smooth (or sawn) side of the cant and adjusts the saw head by raising or lowering the saw head so as to cut a board of a preset thickness, following the curvature of the cant.

In prior art cant cutting saws, such as that described in Kenyon (U.S. Pat. No. 4,127,044), the vertically oriented saw head remains stationary (is not moved up or down or sideways) while the cant is displaced horizontally so that the cant may be cut following the curvature of the cant. A sensing roller 25 (also referred to as a surface locator) senses the curvature on the wany side of the cant (not the smooth, sawn side), and an orienting pressure roller 6 pushes on the cant based on the feedback from the sensing roller 25, thus guiding the cant through the saw head so as to cut the cant while following its curvature. A control pressure roller 13 offers a degree of resistance to the force exerted on the cant by the orienting pressure roller 6.

In Kenyon, the cant is oriented with its curvature on the side instead of on the bottom. However, the smooth (sawn) sides of the cant are on top and on the bottom of the cant. Therefore, the sensing of the curvature is done on the wany side of the cant, which is rough, having bumps and other irregularities that are not present on a smooth, sawn surface. The resulting cut, which follows that rough surface, will also be rough, attempting to conform the cut to all those irregularities in the surface.

Kenyon requires applying a lateral orienting pressure on the work piece. Kenyon moves the cant to orient it so that the fixed position saw blades cut along the curvature. In Kenyon, once the trailing edge of the cant has gone past the cant orientation means (the orienting pressure roller 6), the cant can no longer be shifted laterally to line up the saw blades with the curvature of the cant, so control is lost toward the end of the cut. This means that the end portion of the cut board frequently will not have the correct thickness and will have to be scrapped. Furthermore, the cant is moved laterally by the orienting pressure roller 6 which is also acting against the wany side of the cant, which results in a less accurate alignment of the cant relative to the saw blades and the relative to the curvature of the cant. Kenyon attempts to minimize this adverse effect (refer to FIG. 3) by having the point of contact of the orienting pressure roller 6*a* with the cant as close as possible to the edge(s) closest to the smooth (sawn) surface, and (refer to FIG. 5) by using more than one orienting pressure roller 6*a*, 6*b* and averaging the input from these multiple rollers.

In Kenyon, the sensor must be facing the concave side of the cant. The design will not work if the sensor 25 is facing the convex side of the cant, because the orienting pressure roller 6 can only push the cant away from the sensor 25; it cannot pull the board toward the sensor, as would be required to maintain a constant thickness if the sensor were on the convex side of the cant. Therefore, the cant must be properly oriented relative to the sensor 25 before the cant is fed to this prior art saw. This also means that a cant with a compound curvature (one which is concave in a portion of its length and convex in another portion of its length) cannot be adequately handled by the saw taught in Kenyon.

SUMMARY

In one embodiment of the present invention, shown and described below, the saw head moves to follow the curvature of the cant rather than moving the cant relative to a fixed position saw head.

In that embodiment, a cant is placed on the conveyor feed belt of the saw with the either the concave side or the convex side down. A hold down and feeder assembly assists in feeding the cant through the saw. A sensing means (in this example a shoe) senses the position of the bottom surface of the cant directly underneath the saw head, so as to sense the vertical displacement of the cant relative to the feed belt due to the bowing or curvature of the cant at the saw head. The sensing means transmits this information, via a linkage mechanism, to a sliding magnetic pick-up device. This device is mounted along a probe which is attached to the saw head and which senses the position of the magnetic device relative to a target position and sends a signal to a programmable logic controller which, in turn, causes the saw head to move up and down to follow the curvature of the cant.

Therefore, as the cant is fed through the saw, if the bottom surface of the cant has a concave bow, for instance, the shoe (which is biased upwardly toward the bottom of the cant) moves up. The programmable logic controller will then cause the saw head to move up an equal distance, maintaining the thickness of the board that is being cut.

Other displacement sensing devices, such as electrical, optical, or laser scanners, for instance, may be used to sense the curvature of the cant, and this curvature may be measured at either the bottom surface of the cant, which lies on the conveyor, or at the opposite, top surface of the cant. In either case, the saw head would be moved up and down to follow the curvature of the surface being sensed, in order to maintain the thickness of the cut board. Both the top and bottom surfaces of the cant are smooth, sawn surfaces.

It should be noted that the displacement sensor (i.e. the shoe) is located directly below (or above) the saw blade for greatest accuracy. For a mechanical sensor, such as a shoe, it may be easier to track the displacement of the cant on the bottom surface, because there is no interference from the saw. However, if the sensor does not have to physically touch the cant, such as when the sensor is an optical or laser scanner, this measurement may just as readily be taken at the top surface of the cant, directly above the saw blade.

In the embodiment shown and described below, the sensor (the shoe) has a biasing mechanism to keep the shoe against the bottom surface of the cant. In this same embodiment, this biasing mechanism is an air cylinder. However, the biasing mechanism could be a simple spring or other biasing means. When the air cylinder is not actuated, the shoe lies flush with the top of the conveyor feed belt. Any target position set at this time simply defines the thickness of the cut relative to the feed conveyor, and this dimension remains fixed (the saw head will not be raised or lowered during the cut). However, if the air cylinder is actuated, the shoe will follow the bottom contour of the cant, meaning that the saw head will also follow this same contour at the target thickness (or target position) and the saw will cut a constant thickness board off of the cant, following the curvature of the cant.

As soon as the cant reaches the saw blade, the sensor can immediately begin sensing the position of the bottom surface of the cant, and the programmable logic controller can begin making corresponding corrections to the position of the saw head in order to follow the contour of the cant from the first end to the last end. There is no loss of control at any point throughout the entire length of the cut.

The smooth (sawn) side of the cant is placed on the conveyor, but this side can be either convex or concave, or it can, in fact, have a compound curvature, including both concave and convex portions at different points along its length. The saw can accommodate any of these conditions without requiring any further alignment of the cant relative to the displacement sensor. The sensing by the displacement sensor is done on the smooth side of the cant, not on the wany side, resulting in a smooth, accurate cut.

DESCRIPTION OF THE PREFERRED EMBODIMENTS

Figure 6:
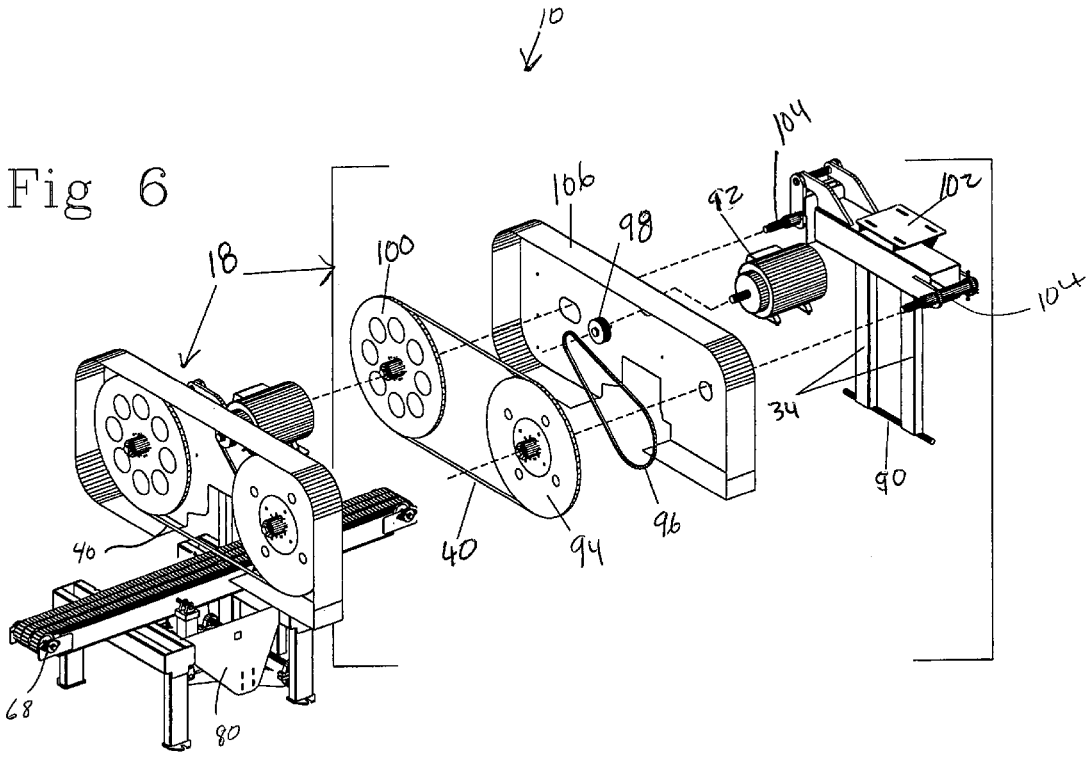
FIG. 6 is a partially exploded, perspective view of the cant saw of FIG. 1, detailing the saw head.
Figure 7:
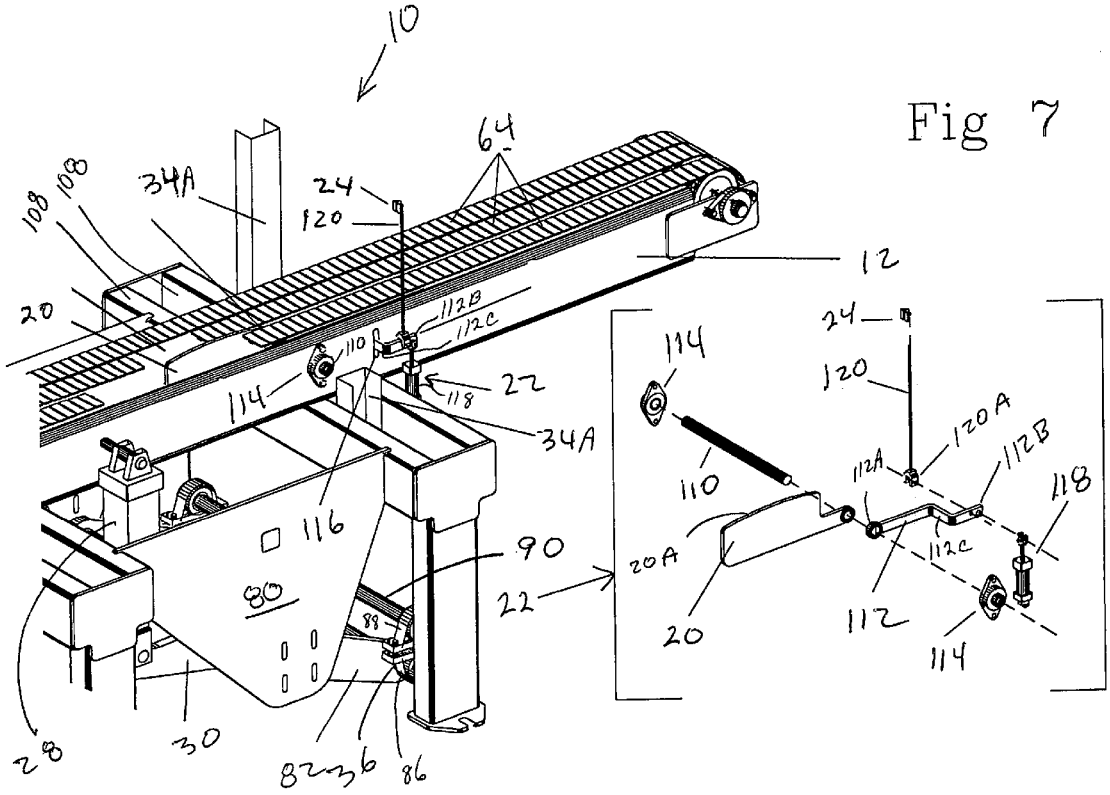
FIG. 7 is a partially exploded, broken away, perspective view of the cant saw of FIG. 1, detailing the sensing shoe and magnetic pick-up sensor mechanism.
Figure 8:
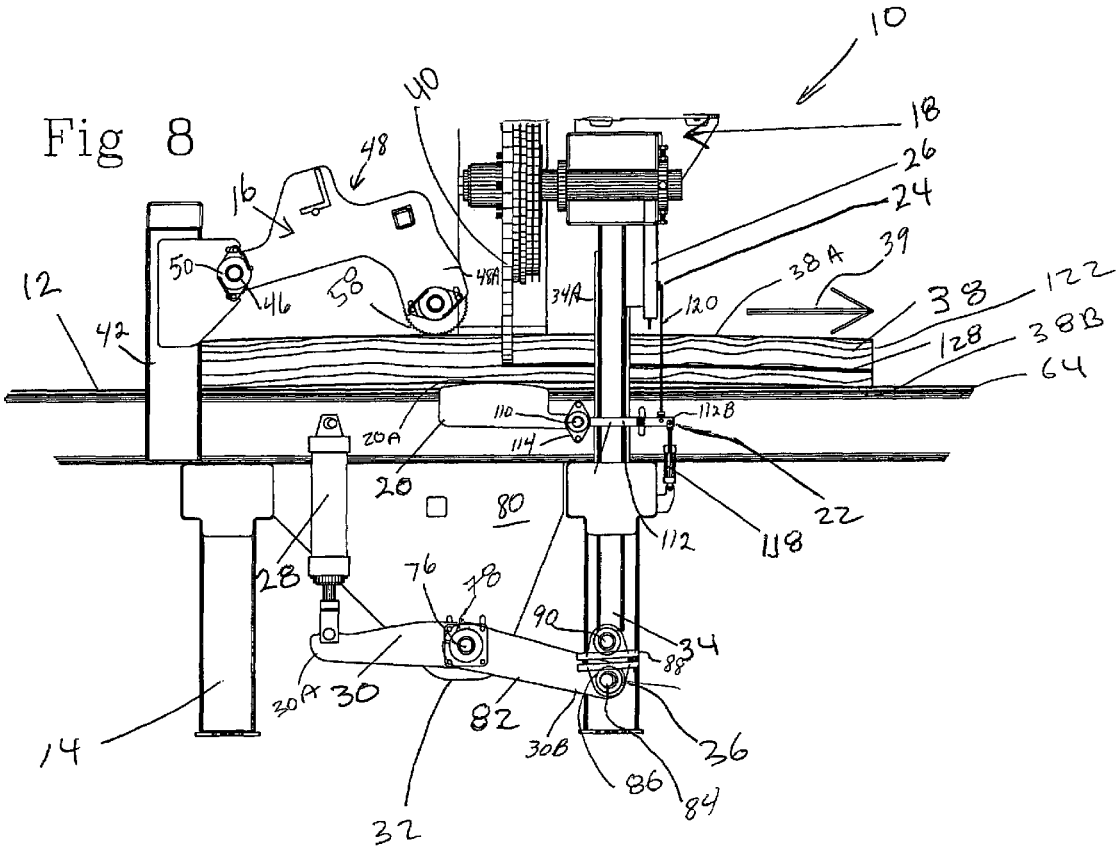
FIG. 8 is a side view, similar to FIG. 1, but showing a cant as it is fed and cut, and with some of the covers removed for clarity, in order to show the sensing shoe mechanism as well as the mechanism to raise and lower the saw head.
Figure 9:
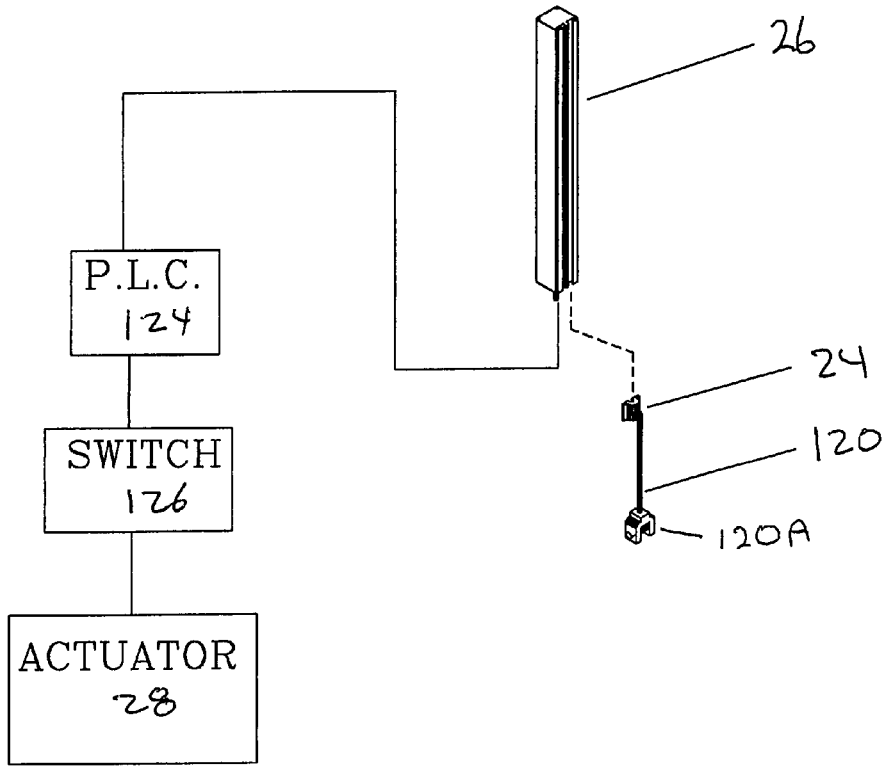
FIG. 9 is a schematic showing the relationship between the magnetic pick-up device, the probe (which is mounted to the saw head), the programmable logic controller, a switch, and the piston actuator.

FIGS. 1 through 8 show a cant saw 10 made in accordance with the present invention. Referring briefly to FIG. 8, the cant saw 10 includes a conveyor table 12 with a frame including legs 14, a hold down and feeder assembly 16, a horizontally cutting saw head 18, and a cant curvature sensing shoe 20. A linkage mechanism 22 connects the sensing shoe 20 to a sliding magnetic pick-up mechanism 24, which slides inside a probe 26 that is fixed relative to the saw head 18. A programmable logic controller 24 (shown in FIG. 9) receives a signal from the probe 26 and, in turn, sends a signal to a piston actuator 28 to extend or retract in order to raise or lower the saw head 18 via an actuator arm 30 which pivots about a fulcrum 32. The actuator arm 30 is connected at one end 30A to the piston actuator 28, and it is connected at the other end 30B to a first pivot shaft 84, which is connected to a saw head lift shaft 90 through a double knuckle arrangement 36. The saw head lift shaft 90 is fixed to a connecting rod 34 (see FIG. 6), which is fixed to the saw head 18, as described in more detail below.

Referring to FIG. 8, the cant 38 is fed into the saw 10 traveling from left to right, as shown by the arrow 39. The hold down assembly 16 (shown in detail in FIG. 3) pushes down against the top surface of the cant 38 as the cant is fed into the saw blade 40, ensuring that the cant is always pressed downwardly against the top surface of the conveyor 12. (Of course, the weight of the cant 38 also helps hold the cant 38 down against the top surface of the conveyor 12.)

Figure 2:
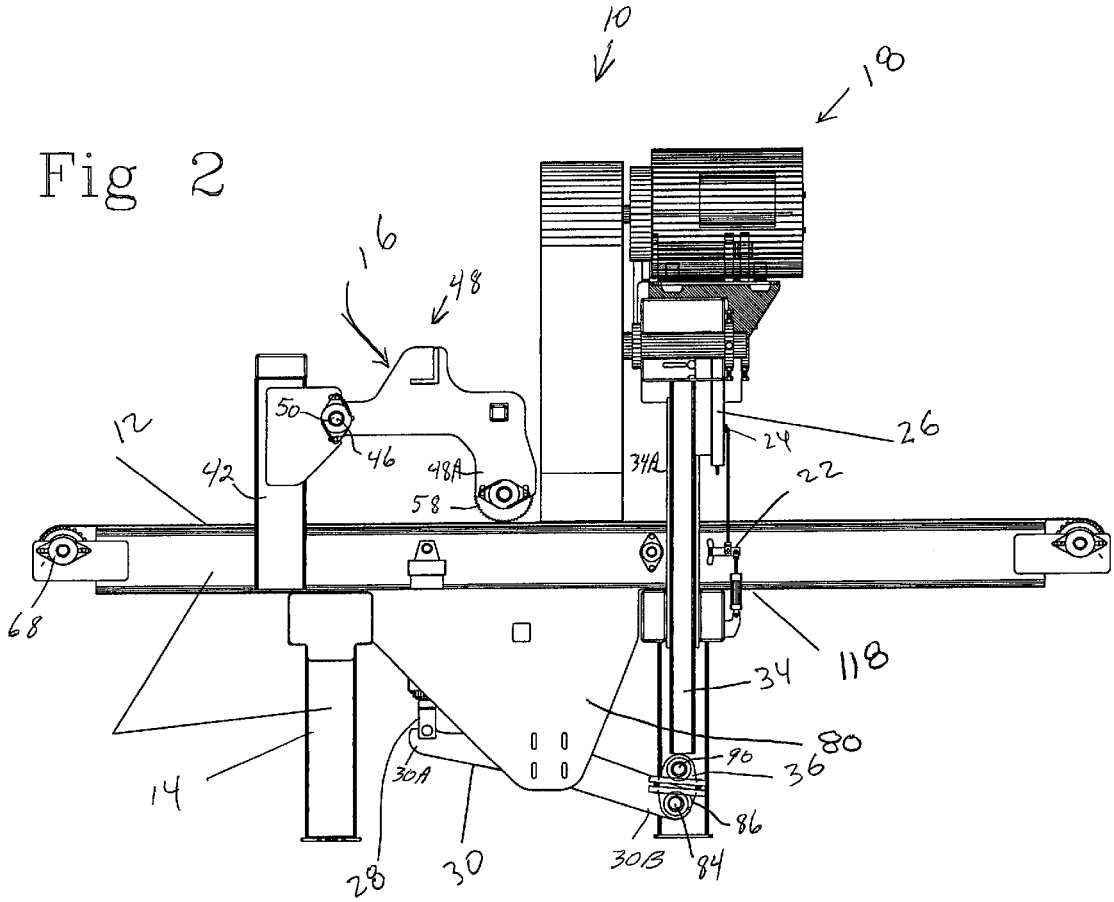
FIG. 2 is the same view as FIG. 1 but with a cover on the saw frame removed for clarity in order to show the double knuckle mechanism used to raise and lower the saw head.
Figure 3:
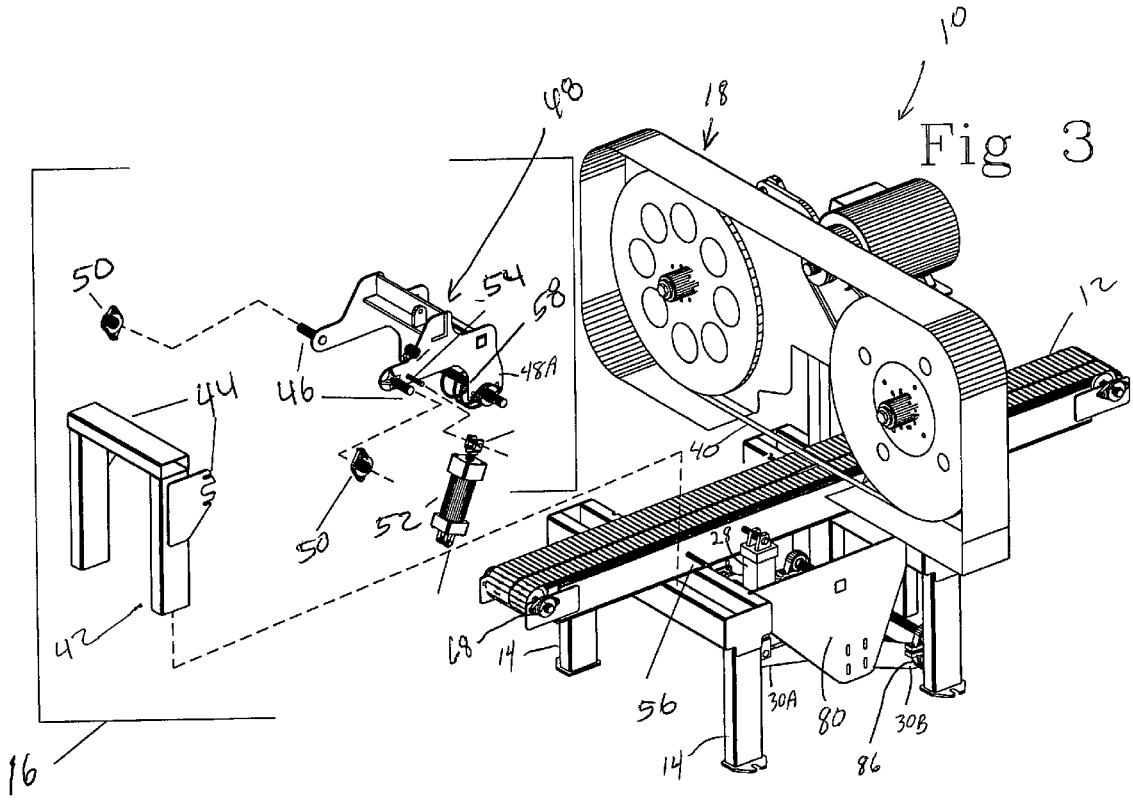
FIG. 3 is a partially exploded, perspective view of the cant saw of FIG. 1, detailing the cant hold down mechanism.

Referring to FIG. 3, the hold down assembly 16 includes a mounting frame 42 defining pivot supports 44 for mounting the bearings 50 for the stub axles 46 of the substantially "L" shaped hold down bracket 48. This allows the free end 48A of the hold down bracket 48 to pivot up and down relative to the stub axles 46. A pneumatic cylinder 52 has its first end secured to the hold down bracket 48 via a first shaft 54 secured to the bracket 48. The second end of the cylinder 52 is secured to the conveyor table 12 via a second shaft 56, secured to the conveyor table 12. The air pressure in the cylinder 52 may be controlled to adjust the pressure biasing the free end 48A of the bracket 48 downwardly, toward the conveyor table 12. This, in turn, controls the force with which the hold down assembly 16 pushes the cant 38 against the conveyor table 12. Toothed rollers 58 (shown also in FIGS. 1, 2, and 8) contact the sawn top surface of the cant 38 to provide a smooth but positive rolling contact between the hold down assembly 16 and the cant 38. Of course, other biasing means, such as a spring, or hydraulically or electrically actuated pistons, could be used in place of the pneumatic cylinder 52.

Figure 4:
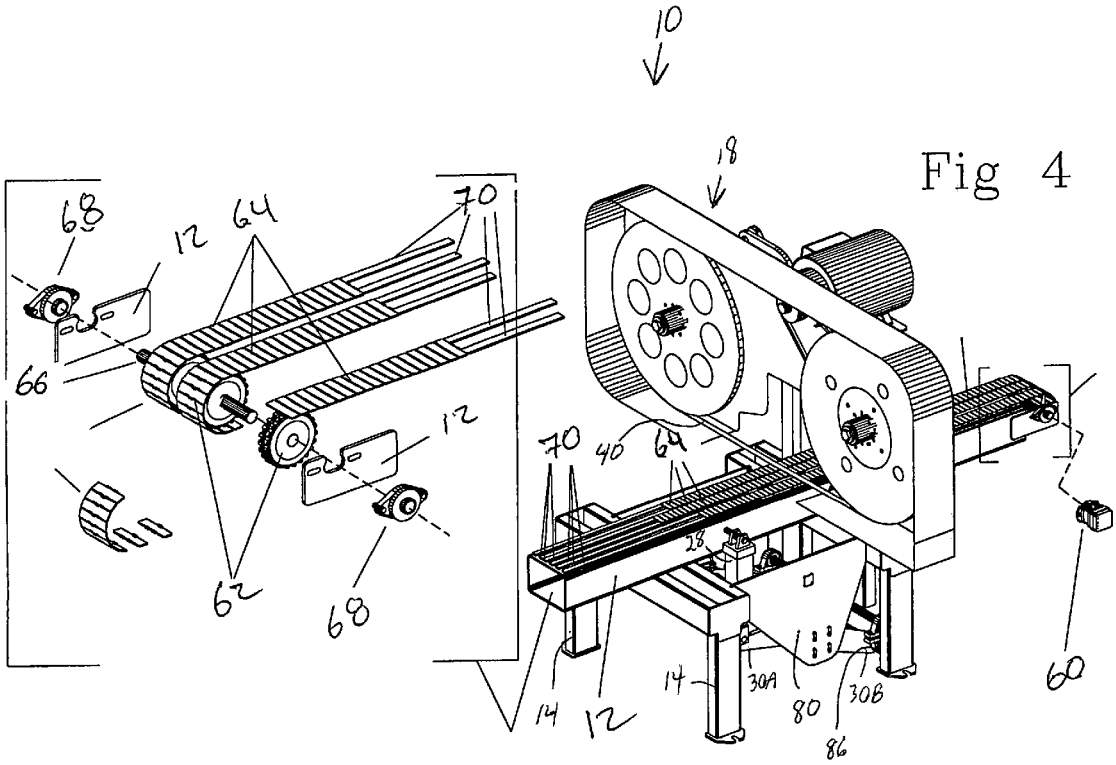
FIG. 4 is a partially exploded, perspective view of the cant saw of FIG. 1, detailing the parts of the conveyor mechanism.

Referring to FIG. 4, the conveyor table 12 includes geared sprockets 62 which engage a plurality of conveyor belts 64 at one end of the conveyor belts 64. The sprockets 62 rotate with a shaft 66 rotatably supported by bearings 68 mounted on the conveyor table 12. A drive motor 60 at the other end of the table 12 drives a similar set of sprockets (not shown) to drive the conveyor belts or chains 64, causing them to travel along tracks 70. As will be explained in more detail later, the sensing shoe 20 projects upwardly through a gap between two adjacent conveyor belts 64 in order to contact the horizontal sawn bottom surface of the cant 38 and track the vertical displacement of that horizontal surface of the cant relative to the top surface of the conveyor.

Figure 1:
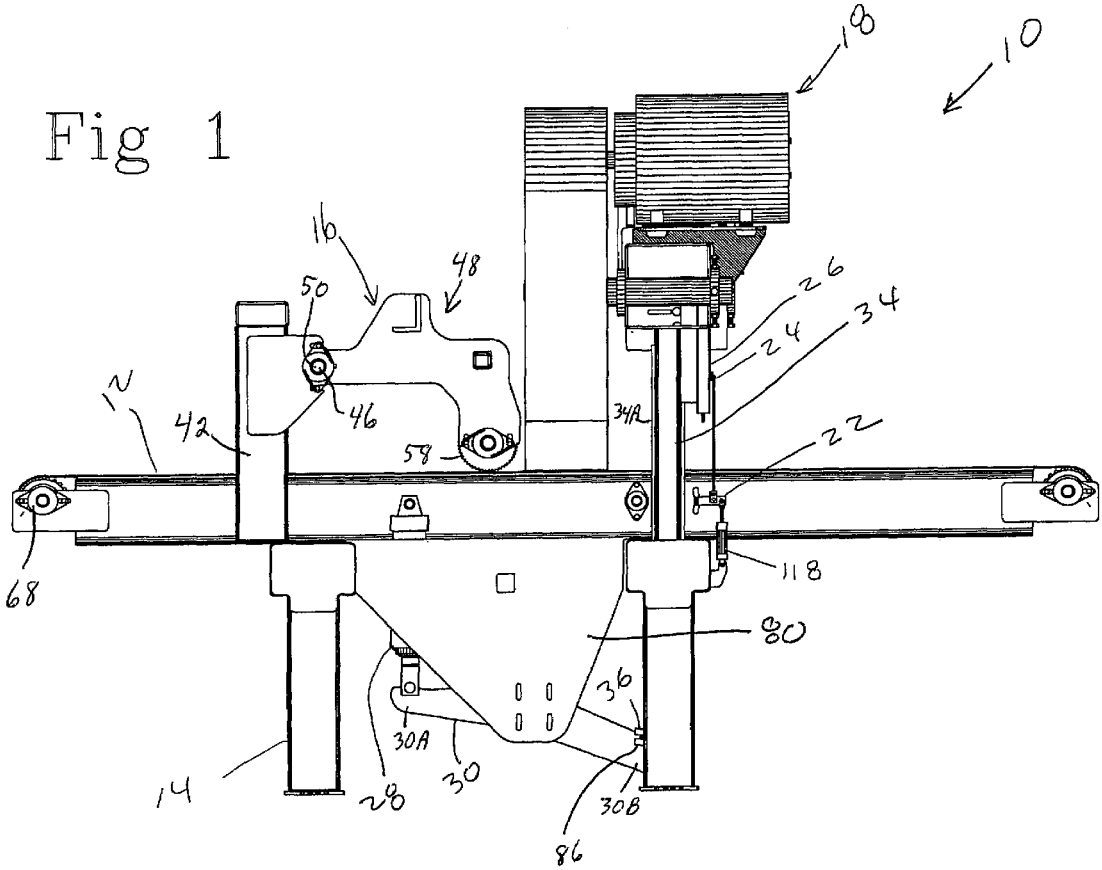
FIG. 1 is a side view of a cant saw made in accordance with the present invention.
Figure 5:
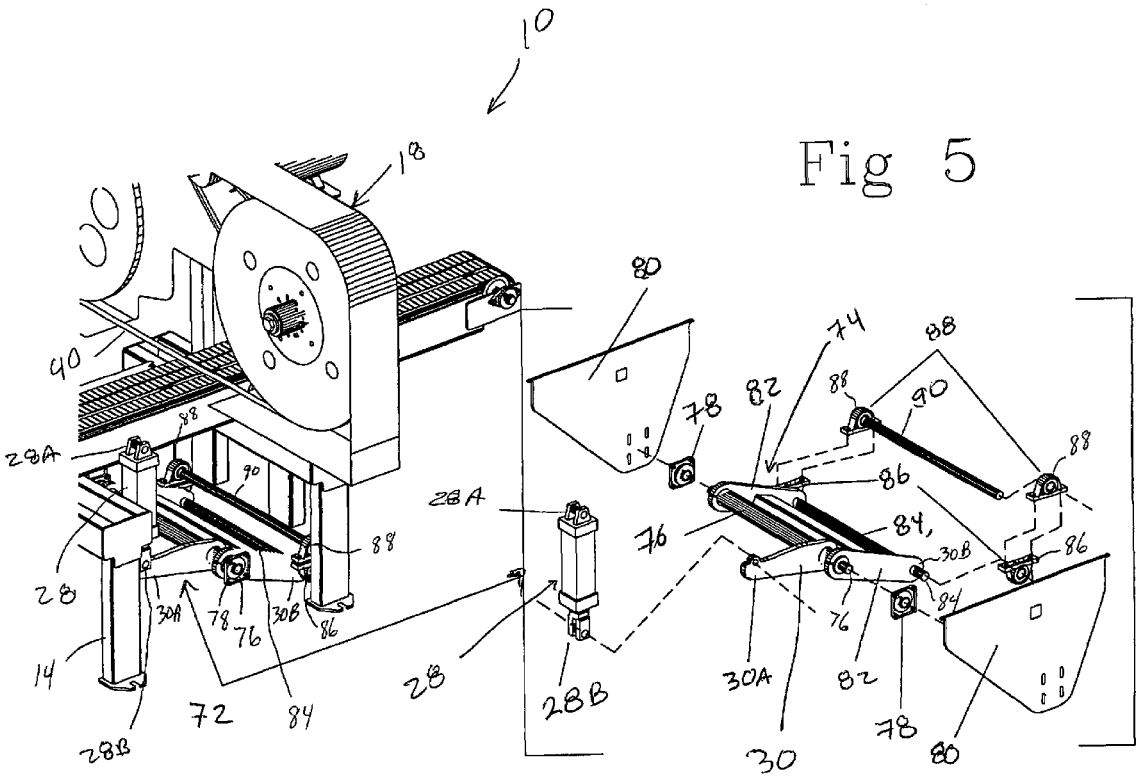
FIG. 5 is a partially exploded, broken away, perspective view of the cant saw of FIG. 1, detailing the cantilevered mechanism with fulcrum and double knuckle arrangement to raise or lower the saw head.

Referring to FIG. 5, a saw head lifting mechanism 72 is used to raise and lower the saw head 18 to ensure that the saw blade 40 follows the displacement of the cant 38 in order to maintain a set thickness of the board that is being cut. A pneumatically actuated cylinder 28 is connected at its first end 28A to the conveyor table 12 and at its second end 28B to the first end 30A of the lever arm 30. The lever arm 30 is part of a pivotable framework 74. This framework 74 includes a main pivot shaft 76, which is rotatably supported by bearings 78 mounted on the inside of panels 80 which are, in turn, secured to the frame of the conveyor table 12 as shown in FIGS. 1 and 2. Two parallel side arms 82 link the main pivot shaft 76 to a lower knuckle pivot shaft 84, which is supported at its ends for rotation by two lower knuckle bearings 86. The saw head lift shaft 90 is supported for rotation at its ends by two upper knuckle bearings 88, which are secured, as by bolts (not shown), to the lower knuckle bearings 86.

This double knuckle mounting arrangement allows for misalignment between the lower knuckle pivot shaft 84 and the saw head lift shaft 90 as the saw head 18 is raised and lowered. Since the axial position of the main shaft 76 is fixed relative to the panels 80 and the saw frame 14, and since the arm 30 pivots with the main shaft 76, the lower pivot shaft 84 defines a slight arc as the lever arm 30 pivots. At the same time, the saw head lift shaft 90 is restricted to travel along a straight vertical line, since, as shown in FIG. 6, the saw head lift shaft 90 is fixed to the connecting rods 34, which slide vertically within a fixed frame 34A, shown in FIGS. 1, 2, and 8. As the connecting rods 34 move up and down, they raise and lower the saw head.

The double knuckle mounting arrangement, with the two sets of bearings 86, 88 fixed together, permits the lower pivot shaft 84 to lie directly below the saw head lift shaft 90 at one point along its travel, as shown in FIG. 5, and it allows the lower pivot shaft 84 to be displaced in a horizontal direction relative to the saw head lift shaft 90, as shown in FIG. 2, so that the lower pivot shaft 84 can follow an arcuate path while the saw head lift shaft 90 follows a vertical path.

Referring to FIG. 6, the saw head 18 includes a motor 92 driving a drive wheel 94 via a drive belt 96 and pulley 98. The saw blade 40 is a flexible blade that extends around the drive wheel 94 and around an idler wheel 100. The motor 92 mounts to a motor mount 102, which also includes two spindles 104 which support the drive and idler wheels 94, 100 for rotation. A stationary safety cover 106 is also mounted on the spindles 104. As discussed above, the saw head 18 is fixed, via the connecting rods 34, to the saw head lift shaft 90.

The connecting rods 34 are guided and constrained to vertical travel by the tracks 34A, best seen in FIG. 7. The tracks 34A are mounted on horizontal cross members 108 of the conveyor table 12. The connecting rods 34 raise and lower the saw head 18 as they travel up and down in the tracks 34A, driven by the piston actuator 28, as will be discussed in more detail later.

FIG. 7 also shows the linkage mechanism 22, which includes a sensing shoe 20 that senses the vertical displacement of the bottom surface of the cant relative to the top surface of the conveyor table 12. The sensing shoe 20 is fixed to an "L" shaped linkage 112. A pivot shaft 110 extends through a first end of the shoe 20 and through a first end 112A of the linkage 112 and is supported at its ends for rotation by bearings 114, which are mounted to the conveyor table 12. The shoe 20, linkage 112, and pivot shaft 110 pivot together relative to the conveyor table 12. The elbow 112C of the L-shaped linkage 112 extends through a side opening 116 in side wall of the conveyor table 12, so the first end 112A of the linkage 112 is inside the side wall and the second end 112B of the L-shaped linkage 112 is outside the side wall. A pneumatic cylinder 118 is secured to the second end 112B of the L-shaped linkage 112. The pneumatic cylinder 118 pulls down on the second end 112B of the linkage 112, which in turn, biases the shoe 20 to a raised position, where it projects upwardly through a gap between the conveyor belts 64, so as to contact the sawn bottom surface 38B of the cant 38 and detect its curvature (See FIG. 8). Of course, other biasing means, such as a spring, or hydraulically or electrically actuated pistons, could be used in place of the pneumatic cylinder 118.

A slender rod 120 extends vertically, with its first end 120A connected to the second end 112B of the L-shaped linkage 112, and its second end attached to a sliding magnetic pick-up 24, which is slidably housed in a probe 26 (See FIG. 8) that is fixed to the saw head 18. The magnetic pick-up 24 is able to slide up and down inside the probe 26 such that the position of the magnetic pick-up 24 relative to the probe 26 changes depending on the following conditions:

First, as the shoe 20 rotates about the pivot shaft 110, the linkage 112 rotates with the shoe 20, causing the second end 112B of the L-shaped linkage 112 to move up and down, thereby raising and lowering the magnetic pick-up 24 within the probe 26.

Second, as the piston actuator 28 extends and retracts, the lever arm 30 and its side arms 82 move accordingly, raising and lowering the double knuckle arrangement 36 which, in turn, raises and lowers the saw head 18 (via the connecting rods 34). Since the probe 26 is secured to the saw head 18, the probe 26 also moves up and down with the saw head 18, changing the position of the magnetic pick-up 24 relative to the probe 26.

The shoe 20 defines a convex cant-contact-surface 20A to help it slide smoothly along the bottom surface 38B of the cant 38. The convex shape also increases the probability that only one point of the surface 20A will be in contact with the bottom surface 38B of the cant 38 at any given time, and this one point is preferably located directly below the blade 40 (or very close thereto) in order to enhance the accuracy of the measurement of the curvature of the cant at the leading edge of the cut of the blade 40. Of course, other shapes of sensing shoes, such as rollers, for instance, may be used instead of the convex surface 20A.

Operation of the Cant Saw referring to FIG. 8, the saw head 18 of the cant saw 10 is first adjusted so that the saw blade 40 is raised to a preset, desired board thickness above the top surface of the conveyor belts 64. This preset distance is the target position for the saw head 18. This preset thickness also is programmed into the programmable logic controller.

A cant 38 is placed on the conveyor table 12 with one of its smooth (or sawn) surfaces 38A facing up and the other smooth surface 38B facing down, and the cant is fed through the saw blade 40 in the direction of the arrow 39 by means of the conveyor belts on the conveyor table 12. The cant may be placed on the conveyor table 12 with either a convex or a concave side on the bottom surface 38B, and in fact the bottom surface 38B may even be both convex and concave; that is, it may be convex for a portion of the cant 38 length and concave for another portion of its length.

The leading edge 122 of the cant 38 first contacts the rollers 58 of the hold down assembly 16, which is preloaded by the pneumatic cylinder 52 (See FIG. 3) to securely press the cant 38 against the conveyor belts 64 (See FIG. 4). If the air cylinder 118 is turned on, in order to bias the shoe 70 upwardly against the bottom surface 38B of the cant 38, then as the cant 38 progresses toward the saw blade 40, the convex surface 20A of the sensing shoe 20 contacts the bottom surface 38B of the cant 38. Note that if the air cylinder 118 is not turned on, the convex surface 20A of the shoe 20 remains flush with the top of the conveyor belts 64 and, as explained in more detail below, the saw head 18 will not be raised or lowered as the cant 38 is fed through the cant saw 10. The result is a straight cut which is parallel to the flat surface of the conveyor belts 64 on the conveyor table 12, instead of a cut which follows the curvature of the cant 38. However, if the air cylinder 118 is turned on, the shoe 20 follows the contour of the bottom surface 38B of the cant 38 and, as explained below, the saw head 18 also follows this same contour but at the aforementioned target position, maintaining a fixed board thickness and resulting in a cut 128 which follows the curvature of the cant 38.

Assuming, for instance, that the bottom surface 38B of the cant 38 is concave (bowed upwardly in the middle), then, as the cant 38 progresses in the direction of the arrow 39 in FIG. 8, this bottom surface 38B will be spaced above the top surface of the conveyor belts 64 (the cant 38 will be supported by the ends of the cant 38 which are still in contact with the conveyor belts 64). The shoe 20, which is biased upwardly by the air cylinder 118, also moves up through a longitudinal gap between the belts 64 (See FIG. 7), such that the convex surface 20A of the shoe 20 remains in contact with the bottom surface 38B of the cant 38, and does so at a point directly below the blade 40. (The statement "directly below the blade" is intended to include anything that is substantially directly below the blade, so that the sensor will be causing the controller to move the cutting head to the correct position to maintain the thickness of the cut board.)

The upward movement of the shoe 20 results in a corresponding downward movement of the end 112B of the "L" shaped linkage 112, as well as a corresponding downward movement of the magnetic pick-up sensor 24 inside the probe 26. The programmable logic controller 124, shown schematically in FIG. 9, senses the change in position (both magnitude and direction) of the magnetic pick-up sensor 24, and it sends a signal, via the switch 126, to the piston actuator 28 to extend, pushing downwardly on the end 30A of the arm 30, causing upward movement of the double knuckle arrangement 36, and raising the saw head 18. The probe 26 is attached to the saw head 18, and thus it also moves upwardly.

The programmable logic controller 124 continues to send a signal for the piston actuator 28 to extend until the probe 26 has moved upwardly an amount equal to the magnitude of the downward movement of the magnetic pick-up 24, such that the algebraic sum of the distances moved by the magnetic pick-up 24 and by the probe 26 is equal to zero.

Of course, as the magnitude of the separation between the top surface of the conveyor belts 64 and the bottom surface 38B of the cant 38 approaches zero (as when the trailing edge of the cant 38 is approached in the above example of a concave bottom surface 38B), the shoe 20 is pushed downwardly against the biasing action of the pneumatic cylinder 118. This results in an upward movement of the end 112B of the linkage 112 and a corresponding upward movement of the magnetic pick-up 24. The probe 26 sends a signal to the programmable logic controller 124, which then sends a signal to the piston actuator 28 to retract so as to lower the saw head 18. In this manner, the saw blade 40 makes a cut 128 which follows the curvature of the bottom surface 38B of the cant 38.

Other Embodiments

Figure 10:
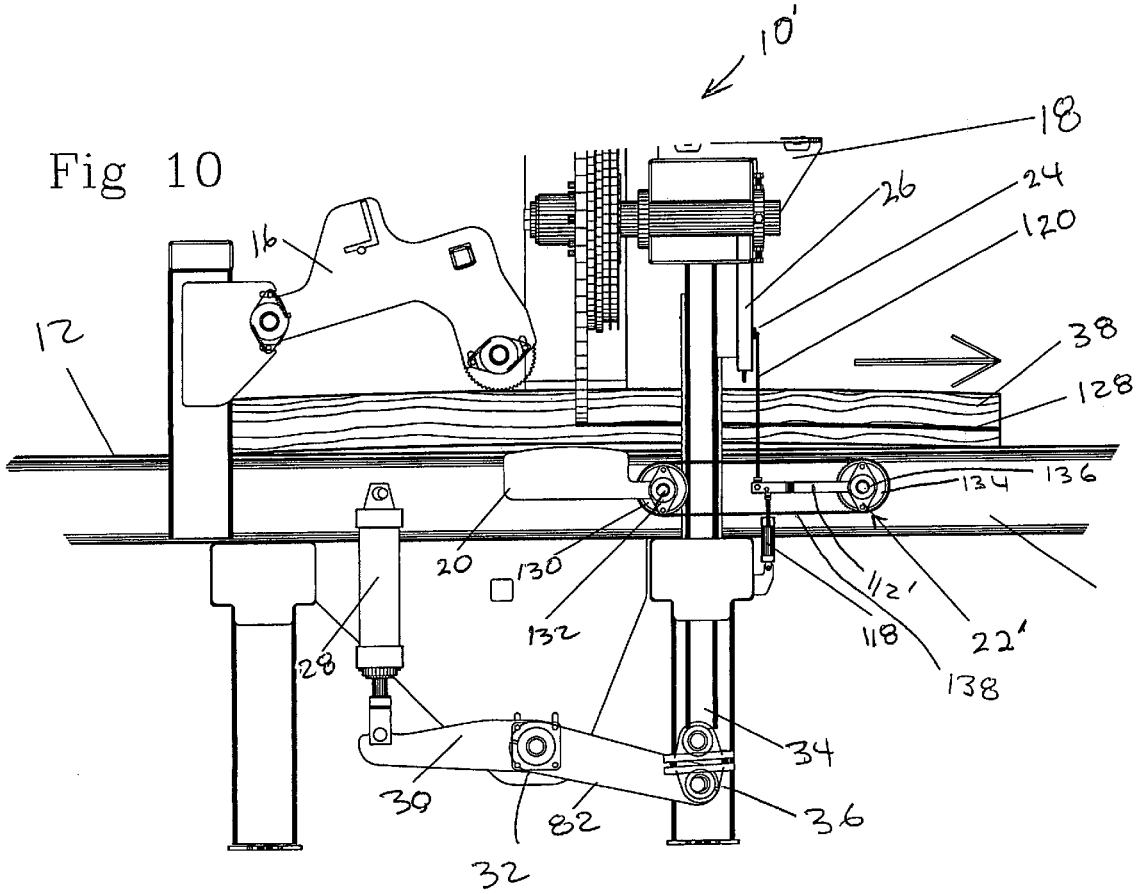
FIG. 10 is a side view, similar to that of FIG. 8, but for a second embodiment of a cant saw made in accordance with the present invention.

FIG. 10 shows a cant saw 10' made in accordance with the present invention. This cant saw 10' is very similar to the cant saw 10 described above, except that the linkage mechanism 22' is different and results in a movement of the magnetic pick-up device 24 which is equal to the movement of the sensing shoe 20, instead of the inversely proportional relationship of the linkage mechanism 22 of the first cant saw 10.

In this linkage mechanism 22', the shoe 20 and its corresponding shoe timing gear 130 pivot about a shoe pivot shaft 132. The "L" shaped linkage 112' and its corresponding linkage timing gear 134 pivot about a linkage pivot shaft 136. A timing chain 138 meshes with both the shoe timing gear 132 and the linkage timing gear 134 such that rotation of either one of the timing gears 130, 134 results in an identical rotation of the other of the timing gears 130, 134. In this arrangement, the linkage arm 112' and the magnetic pick-up 24 are connected via the rod 120 and faithfully track the up and down movement of the sensing shoe 20. The cylinder 118 is mounted to the L-shaped linkage 112' and, through the timing chain 138, biases the shoe 20 upwardly. The movement of the magnetic pick-up 24 is equal in direction and distance to the movement of the sensing shoe 20.

In this instance, the programmable logic controller 124 need only signal the piston actuator 28 to extend or retract until the position of the magnetic pick-up 24 relative to the probe 26 is once again at the target position. For instance, should the shoe 20, and therefore the magnetic pick-up 24, move up ½ inch, the programmable logic controller instructs the piston actuator 28 to extend until the saw head 18 (and thus also the probe 26 which is attached to the saw head 18) moves up ½ inch, such that the position of the magnetic pick-up 24 relative to the probe 26 returns to its starting position. Thus, in this instance, the algebraic difference of the distances moved by the magnetic pick-up 24 and by the probe 26 is equal to zero.

Figure 11:
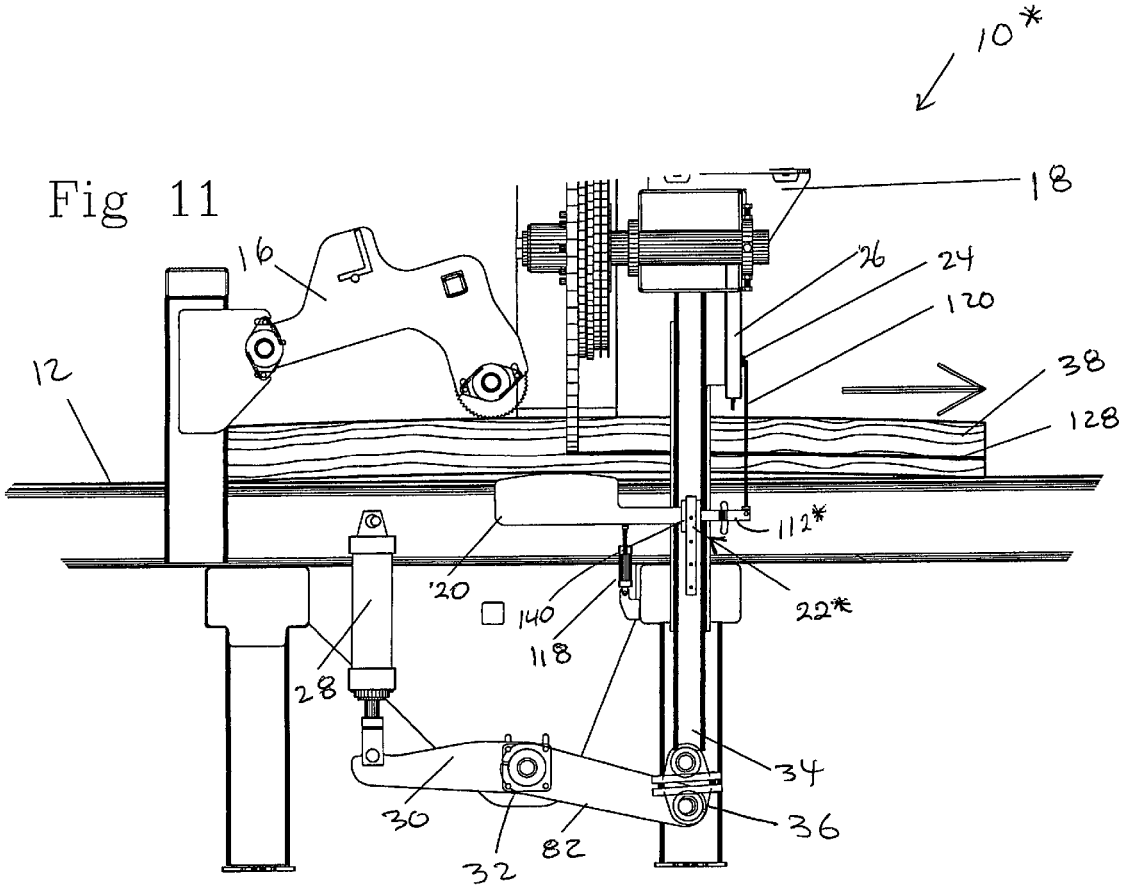
FIG. 11 is a side view, similar to that of FIG. 8, but for a third embodiment of a cant saw made in accordance with the present invention.

FIG. 11 shows another embodiment of a cant saw 10* made in accordance with the present invention. This cant saw 10* is very similar to the cant saw 10' described above, except that the linkage mechanism 22* uses a linear bearing 140 to provide equal movement of the sensing shoe 20, the linkage arm 112*, and the magnetic pick-up device 24. As in the case of the cant saw 10', the movement of the magnetic pick-up 24 is in the same direction as the movement of the sensing shoe 20. Therefore, the operation of the programmable logic controller 124 and of the rest of the saw head height adjustment mechanism for this cant saw 10* is the same as that of the cant saw 10'.

While the embodiments described above show several means for sensing the curvature of a cant and for adjusting the height of the saw blade in order for the cut to follow this curvature, various other sensing and adjusting mechanisms could be used. For instance, as has already been mentioned, the sensing could be done on the top surface of the cant instead of on the bottom surface. Also, the curvature could be sensed via other sensing devices including rollers instead of a shoe, or even by using "virtual" sensing devices such as lasers or optical or electronic sensors. Also, the raising and lowering of the saw head could be done directly via linear displacement devices monitored by position switches in order to obtain the required movement of the saw head as indicated by the sensing device. It will be obvious to those skilled in the art that modifications may be made to the embodiments described above without departing from the scope of the present invention as defined by the claims.

What is claimed is:

1. A saw for cutting a cant along a curved surface, comprising:

a conveyor frame defining a substantially horizontal conveying surface for supporting a cant;

a saw head mounted for vertical movement relative to said conveying surface;

a horizontally cutting saw blade mounted on said saw head;

a curvature sensor for sensing the displacement of a horizontal surface of the cant above the conveying surface;

a controller in communication with said sensor; and means for moving said saw head up and down in accordance with a signal from the controller to track the displacement of the horizontal surface of the cant in order to maintain a set board thickness, said means for moving said saw head up and down including a lift lever mounted for pivoting movement relative to said conveyor frame; and an actuator connected to a first end of said lift lever and in communication with said controller;

wherein said lift lever includes a pivot shaft at a second end of said lift lever, said pivot shaft being supported for rotation by a pair of pivot shaft bearings:

wherein said curvature sensor senses the displacement of the cant surface directly below said saw blade and includes a shoe mounted for pivoting movement relative to said conveyor frame; a magnetic device which moves along with the shoe: a probe which senses the movement of said magnetic device; and a biasing means which urges said shoe upwardly into contact with the bottom surface of the cant; and further comprising a saw head lift shaft extending parallel to said pivot shaft and fixed relative to said saw head; said saw head lift shaft being supported for rotation by a pair of saw head lift shaft bearings; wherein said pivot shaft bearings are fixed to said saw head lift shaft bearings, respectively, thereby allowing for horizontal displacement between said pivot shaft and said saw head lift shaft as said lift lever pivots relative to said conveyor frame to raise and lower said saw head.

* * * * *